US010657899B2

(12) United States Patent
Zeng

(10) Patent No.: US 10,657,899 B2
(45) Date of Patent: May 19, 2020

(54) PIXEL COMPENSATION CIRCUIT, DRIVING METHOD FOR THE SAME AND AMOLED DISPLAY PANEL

(71) Applicant: Wuhan China Star Optoelectronics Semiconductor Display Technology Co., Ltd., Wuhan, Hubei (CN)

(72) Inventor: Mian Zeng, Hubei (CN)

(73) Assignee: WUHAN CHINA STAR OPTOELECTRONICS SEMICONDUCTOR DISPLAY TECHNOLOGY CO., LTD., Wuhan, Hubei (CN)

( * ) Notice: Subject to any disclaimer, the term of this patent is extended or adjusted under 35 U.S.C. 154(b) by 0 days.

(21) Appl. No.: 16/174,699

(22) Filed: Oct. 30, 2018

(65) Prior Publication Data

US 2019/0392760 A1 Dec. 26, 2019

Related U.S. Application Data

(63) Continuation of application No. PCT/CN2018/104469, filed on Sep. 7, 2018.

(30) Foreign Application Priority Data

Jun. 22, 2018 (CN) ..... 2018 1 0651072

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/0842* (2013.01); *G09G 2320/045* (2013.01)

(58) Field of Classification Search
CPC ..... G09G 3/3258; G09G 3/3266; G09G 2300/0842; G09G 2320/045
See application file for complete search history.

(56) References Cited

U.S. PATENT DOCUMENTS

2018/0005569 A1* 1/2018 Li ..... G09G 3/3233
2019/0189056 A1* 6/2019 Gai ..... G09G 3/3258

FOREIGN PATENT DOCUMENTS

CN 102314829 A 1/2012

* cited by examiner

*Primary Examiner* — Alexander Eisen
*Assistant Examiner* — Kebede T Teshome
(74) *Attorney, Agent, or Firm* — Leong C. Lei

(57) ABSTRACT

A pixel compensation circuit is disclosed. The circuit includes a light-emitting device, a reset module, a storage capacitor, a first, a second, a third, a fifth, and a sixth thin-film transistors. The reset module resets the gate of the first thin-film transistor and the anode of the light-emitting device according to a second scanning signal. A drain and a gate of the second thin-film transistor are connected to a data signal and the first scanning signal. The first scanning signal includes one or at least two continuous pulses in one frame time. When the AMOLED display panel needs a black insertion, a black insertion time is between a first pulse of the first scanning signal and a pulse of the second scanning signal, when the second scanning signal includes at least two continuous pulses within one frame time, at least two continuous pulses correspond to pulses of the data signal.

11 Claims, 7 Drawing Sheets

PIXEL COMPENSATION CIRCUIT, DRIVING METHOD FOR THE SAME AND AMOLED DISPLAY PANEL

CROSS-REFERENCE TO RELATED APPLICATION

This application is a continuing application of PCT Patent Application No. PCT/CN2018/104469, entitled "PIXEL COMPENSATION CIRCUIT, DRIVING METHOD FOR THE SAME AND AMOLED DISPLAY PANEL", filed on Sep. 7, 2018, which claims priority to China Patent Application No. 201810651072.0 filed on Jun. 22, 2018, both of which are hereby incorporated in its entireties by reference.

FIELD OF THE INVENTION

The present invention relates to a display technology field, and more particularly to a pixel compensation circuit, a driving method for the same and an AMOLED display panel.

BACKGROUND OF THE INVENTION

The OLED (Organic Light-Emitting Diode) display panel has the advantages of wide color gamut, high contrast, energy saving, and foldability such that the OLED has strong competitiveness in the display of the new era. The AMOLED (Active-matrix organic light-emitting diode) display technology is one of the key development directions of flexible display. The basic driving circuit of the AMOLED display is 2T1C, which includes a switching thin-film transistor, a driving thin-film transistor and a storage capacitor Cst. Since the threshold voltage Vth of the driving thin-film transistor is easily drifted, the driving current of the OLED is fluctuated, which causes a defect in the OLED display panel and affects image quality. In order to improve the display quality, various companies have proposed several kinds of pixel compensation circuits. FIG. 1 and FIG. 2 are respectively a pixel compensation circuit and an operation timing of the pixel compensation circuit. It is divided into three operational phases:

The first phase: the scanning signal S(n−1) is set at a low voltage level, the thin-film transistors T4 and T7 are turned on, and the gate of the driving thin-film transistor T1 and the voltage level of the anode of the OLED are reset to VI.

The second phase: the scanning signal S(n) is set at a low voltage level, the thin-film transistors T2 and T3 are turned on, and the voltage level of the gate of the driving thin-film transistor T1 is Vdata-Vth, wherein Vdata is the voltage of the data signal, and Vth is the threshold voltage of the driving thin-film transistor T1.

The third phase: the enable signal EM(n) is set at a low voltage level and the OLED is illuminated.

In the second phase, T1, T2, and T3 are all turned on, and T4, T5, and T6 are all turned off. At this time, the data signal charges the gate of T1 through the T1, T2, and T3. When the voltage level of the gate of T1 rises to Vdata-Vth, T1 is turned off, and the voltage level of the gate of T1 is no longer rising.

However, in a high scanning frequency, high resolution display panel, the charging time of each row of pixels is shorter, and the charging of the data signal to T1 will be slower and slower in the later phase such that the gate of T1 is difficult to be charged to an expected voltage in a short period of time, and there is a problem that the charging is not full in one frame time, and the corresponding OLED cannot be normally illuminated, which affects the display quality of the display panel under dynamic pictures and the like.

On the other hand, in the existing black insertion technique, by adjusting the period of the high voltage level of the light-emitting signal EM(n) (when the light-emitting signal EM(n) is high, T5 and T6 are turned off, no current flows through the OLED, so that the OLED does not emit light during this period) at the low grayscale level (for example, grayscale levels below 128 grayscale level), the light-emitting time in one frame of the OLED display panel is reduced. However, when the light-emitting signal EM(n) is at a high voltage level, T1 still operates normally in the saturation region, which reduces the lifetime of the entire pixel compensation circuit.

SUMMARY OF THE INVENTION

To solve the above technical problem, the present invention provides a pixel compensation circuit and a driving method thereof, and an AMOLED display panel, which can extend the service life of the pixel compensation circuit and improve the display quality of the display panel.

The present invention provides a pixel compensation circuit for using in an AMOLED display panel, comprising: a light-emitting device, a reset module, a storage capacitor, a first thin-film transistor, a second thin-film transistor, a third thin-film transistors, a fifth thin-film transistor, and a sixth thin-film transistor; wherein both ends of the storage capacitor are respectively connected to a drain of the fifth thin-film transistor and a gate of the first thin-film transistor; wherein a drain and a gate of the fifth thin-film transistor are respectively connected to a power supply voltage signal and the light-emitting signal, and a source of the fifth thin-film transistor is connected to a drain of the first thin-film transistor; wherein a source of the first thin-film transistor is connected to a drain of the sixth thin-film transistor, a source of the sixth thin-film transistor is connected to an anode of the light-emitting device, and a gate of the sixth thin-film transistor is connected to the light-emitting signal, a cathode of the light-emitting device is connected to a common terminal signal; wherein the reset module is used to reset the gate of the first thin-film transistor and the anode of the light-emitting device according to a second scanning signal, and the second scanning signal includes a pulse in one frame period; wherein a drain and a gate of the second thin-film transistor are respectively connected to a data signal and the first scanning signal, and a source of the second thin-film transistor is connected to the drain of the first thin-film transistor; and wherein a drain of the third thin-film transistor is connected to the drain of the fifth thin-film transistor through the storage capacitor, a gate of the third thin-film transistor is connected to the first scanning signal, and a source of the third thin-film transistor is connected to the source of the first thin-film transistor.

Wherein the reset module includes: a fourth thin-film transistor and a seventh thin-film transistor; wherein gates of the fourth thin-film transistor and the seventh thin-film transistor are both connected to the second scanning signal, and drains of the fourth thin-film transistor and the seventh thin film transistor are both connected to a reset signal, and sources of the fourth thin-film transistor and the seventh thin-film transistor are respectively connected to the gate of the first thin-film transistor and the anode of the light-emitting device.

Wherein the first scanning signal includes one or at least two continuous pulses in one frame time, and when the AMOLED display panel needs to perform a black insertion, a black insertion time is between a first pulse of the first scanning signal and a pulse of the second scanning signal, when the second scanning signal includes at least two continuous pulses within one frame time, at least two continuous pulses correspond to pulses of the data signal; when the AMOLED display panel does not need to perform a black insertion, a time interval between the first pulse in the first scanning signal and the pulse in the second scanning signal is zero.

Wherein the thin-film transistors in the pixel compensation circuit are all P-type thin-film transistors.

The present invention also provides a AMOLED display panel, comprising: a first GOA driving circuit, a second GOA driving circuit, a third GOA driving circuit, and multiple pixel compensation circuits; wherein each pixel compensation circuit comprises: a light-emitting device, a reset module, a storage capacitor, a first thin-film transistor, a second thin-film transistor, a third thin-film transistors, a fifth thin-film transistor, and a sixth thin-film transistor; wherein both ends of the storage capacitor are respectively connected to a drain of the fifth thin-film transistor and a gate of the first thin-film transistor; wherein a drain and a gate of the fifth thin-film transistor are respectively connected to a power supply voltage signal and the light-emitting signal, and a source of the fifth thin-film transistor is connected to a drain of the first thin-film transistor; wherein a source of the first thin-film transistor is connected to a drain of the sixth thin-film transistor, a source of the sixth thin-film transistor is connected to an anode of the light-emitting device, and a gate of the sixth thin-film transistor is connected to the light-emitting signal, a cathode of the light-emitting device is connected to a common terminal signal; wherein the reset module is used to reset the gate of the first thin-film transistor and the anode of the light-emitting device according to a second scanning signal, and the second scanning signal includes a pulse in one frame period; wherein a drain and a gate of the second thin-film transistor are respectively connected to a data signal and the first scanning signal, and a source of the second thin-film transistor is connected to the drain of the first thin-film transistor; wherein a drain of the third thin-film transistor is connected to the drain of the fifth thin-film transistor through the storage capacitor, a gate of the third thin-film transistor is connected to the first scanning signal, and a source of the third thin-film transistor is connected to the source of the first thin-film transistor; wherein the first GOA driving circuit includes multiple cascaded first GOA units, the second GOA driving circuit includes a multiple cascaded second GOA units, the third GOA driving circuit includes multiple cascaded third GOA units, each pixel compensation circuit is connected with one of the first GOA units, one of the second GOA units and one of the third GOA units; wherein the third GOA unit is used to output a light-emitting signal to the gate of the fifth thin-film transistor and the gate of the sixth thin-film transistor; wherein the first GOA unit is used to output the first scanning signal to the pixel compensation circuit, and the second GOA unit is used to output the second scanning signal to the pixel compensation circuit.

Wherein multiple pixel compensation circuits are arranged as a matrix, a same row of the pixel compensation circuits is inputted with a same first scanning signal and a same second scanning signal, and a same column of the pixel compensation circuits is inputted with a same data signal; wherein the first scanning signal accessed by an nth row of the pixel compensation circuits includes m pulses in one frame time, the first m−1 pulses of the m pulses correspond to pulses of the data signal to be accessed by the a previous row of pixel compensation circuits of the nth row of the pixel compensation circuits, and a last pulse of the m pulses corresponds to a pulse of the data signal to be accessed by the nth row of the pixel compensation circuits.

Wherein the reset module includes: a fourth thin-film transistor and a seventh thin-film transistor; wherein gates of the fourth thin-film transistor and the seventh thin-film transistor are both connected to the second scanning signal, and drains of the fourth thin-film transistor and the seventh thin film transistor are both connected to a reset signal, and sources of the fourth thin-film transistor and the seventh thin-film transistor are respectively connected to the gate of the first thin-film transistor and the anode of the light-emitting device.

Wherein the first scanning signal includes one or at least two continuous pulses in one frame time, and when the AMOLED display panel needs to perform a black insertion, a black insertion time is between a first pulse of the first scanning signal and a pulse of the second scanning signal, when the second scanning signal includes at least two continuous pulses within one frame time, at least two continuous pulses correspond to pulses of the data signal; when the AMOLED display panel does not need to perform a black insertion, a time interval between the first pulse in the first scanning signal and the pulse in the second scanning signal is zero.

Wherein the thin-film transistors in the pixel compensation circuit are all P-type thin-film transistors.

The present invention also provides a driving method for a pixel compensation circuit for using in an AMOLED display panel, wherein the pixel compensation circuit comprises: a light-emitting device, a reset module, a storage capacitor, a first thin-film transistor, a second thin-film transistor, a third thin-film transistors, a fifth thin-film transistor, and a sixth thin-film transistor; wherein both ends of the storage capacitor are respectively connected to a drain of the fifth thin-film transistor and a gate of the first thin-film transistor; wherein a drain and a gate of the fifth thin-film transistor are respectively connected to a power supply voltage signal and the light-emitting signal, and a source of the fifth thin-film transistor is connected to a drain of the first thin-film transistor; wherein a source of the first thin-film transistor is connected to a drain of the sixth thin-film transistor, a source of the sixth thin-film transistor is connected to an anode of the light-emitting device, and a gate of the sixth thin-film transistor is connected to the light-emitting signal, a cathode of the light-emitting device is connected to a common terminal signal; wherein the reset module is used to reset the gate of the first thin-film transistor and the anode of the light-emitting device according to a second scanning signal, and the second scanning signal includes a pulse in one frame period; wherein a drain and a gate of the second thin-film transistor are respectively connected to a data signal and the first scanning signal, and a source of the second thin-film transistor is connected to the drain of the first thin-film transistor; and wherein a drain of the third thin-film transistor is connected to the drain of the fifth thin-film transistor through the storage capacitor, a gate of the third thin-film transistor is connected to the first scanning signal, and a source of the third thin-film transistor is connected to the source of the first thin-film transistor; wherein the driving method for a pixel compensation circuit comprises steps of: outputting a second scanning signal to the reset module to reset the gate of the first thin-film transistor and the anode of the light-emitting device; and outputting a first scanning signal to the gates of the second thin-film transistor and the third thin-film transistor; wherein the second scanning signal includes one pulse in one frame time, the first scanning signal includes one or at least two continuous pulses in one frame time, and when the AMOLED display panel needs to perform a black insertion, a black insertion time is between a first pulse of the first scanning signal and a pulse of the second scanning signal, when the second scanning signal includes at least two continuous pulses within one frame time, at least two continuous pulses correspond to pulses of the data signal accessed at the drain of the second thin-film transistor.

Wherein when the number of the pixel compensation circuits is multiple and the multiple pixel compensation circuits are arranged as a matrix, the driving method for the pixel compensation circuit includes the following steps: outputting the first scanning signal and the second scanning signal to each row of the pixel compensation circuits, and outputting the data signal DT to each column of the pixel compensation circuits; wherein outputting the same first scanning signal and the same second scanning signal to the same row of the pixel compensation circuits, and outputting the same data signal DT to the same column of the pixel compensation circuits, and the first scan signal includes m pulses; wherein the first m−1 pulses of the m pulses accessed by an nth row of the pixel compensation circuits includes m pulses in one frame time correspond to pulses of the data signal to be accessed by the a previous row of pixel compensation circuits of the nth row of the pixel compensation circuits, and a last pulse of the m pulses corresponds to a pulse of the data signal DT to be accessed by the nth row of the pixel compensation circuits, n>2, m>2.

Wherein when outputting the first scanning signal to the first row of the pixel compensation circuits, the data signal DT includes pulses corresponding to m pulses of the first scanning signal received by the first row of the pixel compensation circuits; and when outputting the first scanning signal to the second row of pixel compensation circuits, the data signal DT includes pulses corresponding to m pulses of the first scanning signal received by the second row of the pixel compensation circuits.

Wherein when the AMOLED display panel does not need to perform a black insertion, the interval between the first pulse in the first scanning signal and the pulse in the second scanning signal is zero.

The implementation of the present invention has the following beneficial effects: in the pixel compensation circuit provided by the present invention, the interval between the pulse of the first scanning signal and the pulse of the second scanning signal can be adjusted to a black insertion time within one frame time, The pixel compensation circuit is not turned on during the black insertion time, so that the first thin-film transistor T1 does not operate in a saturated state, thereby prolonging the service life of the pixel compensation circuit. Moreover, the number of pulses of the first scanning signal is adjusted within one frame time such that the pulse of the first scanning signal within one frame time corresponds to the pulse of the data signal DT. The pixel compensation circuit can be pre-charged for the first thin-film transistor T1 several times before. When the pixel compensation circuit is turned on for the last time, the first thin film transistor T1 can be quickly charged to the on state. Accordingly, the situation that the charging time is slow and the first thin-film transistor T1 cannot be fully turned on so that the corresponding light emitting device cannot be normally displayed, which affects the display effect of the display panel is avoided. Therefore, the present invention cannot only extend the service life of the pixel compensation circuit, but also improve the display effect and quality of the display panel.

BRIEF DESCRIPTION OF THE DRAWINGS

In order to more clearly illustrate the embodiments of the present invention or the technical solutions in the prior art, the drawings used in the embodiments or the prior art description will be briefly introduced below. Obviously, the drawings in the following description are only some embodiments of the present invention. For those of ordinary skill in the art, without creative labor, other drawings can also be obtained from these figures.

DETAILED DESCRIPTION OF PREFERRED EMBODIMENTS

Figure 1:
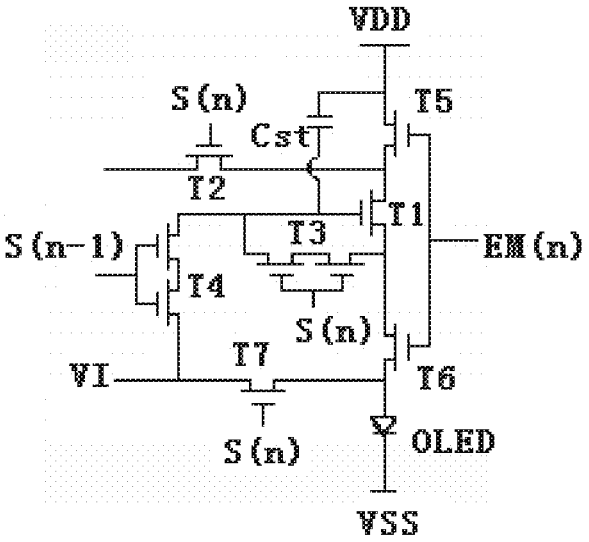
FIG. 1 (Prior art)
FIG. 1 is a schematic diagram of a pixel compensation circuit in the background art provided by the present invention.
Figure 2:
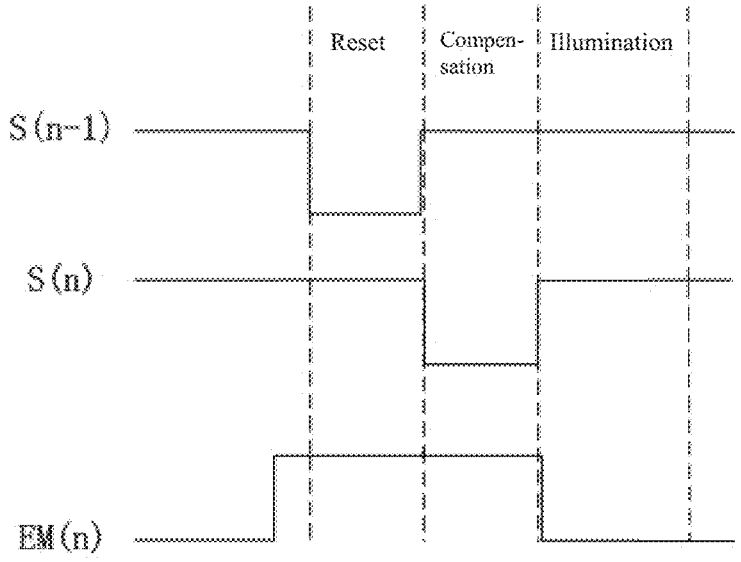
FIG. 2 (Prior art)
FIG. 2 is a timing chart of a pixel compensation circuit in the background art provided by the present invention.
Figure 3:
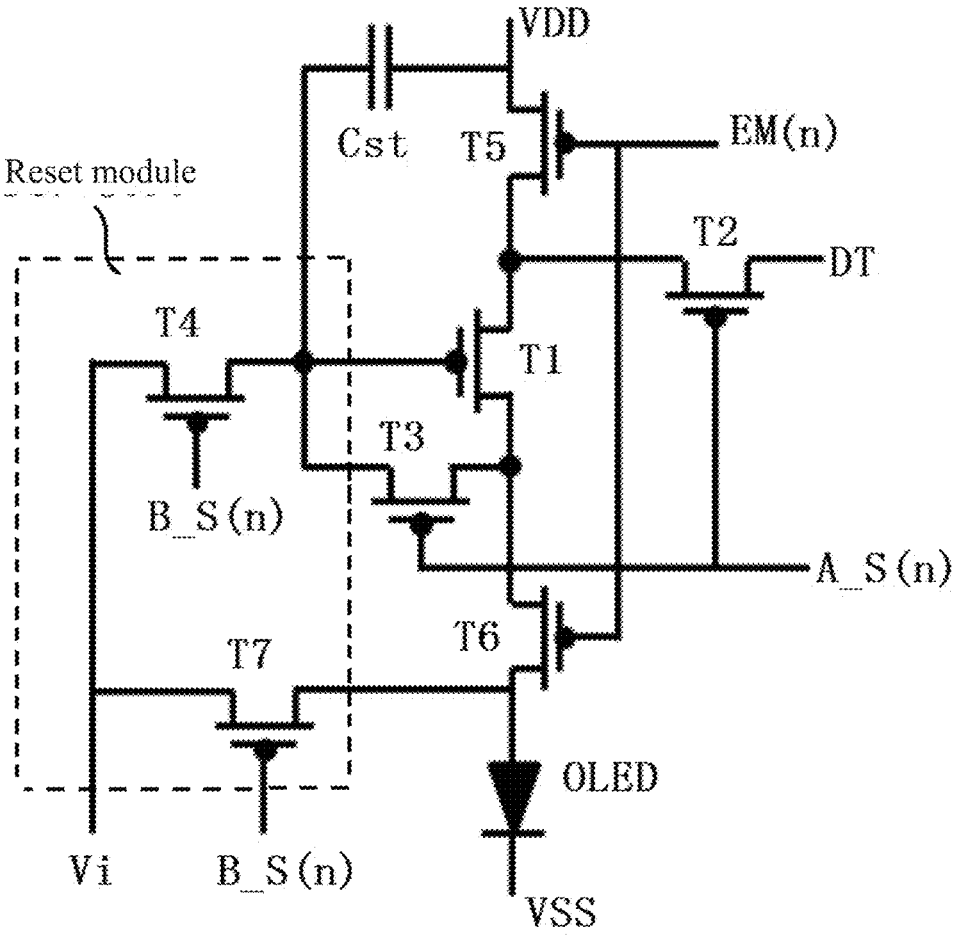
FIG. 3 is a schematic diagram of a pixel compensation circuit provided by the present invention.

The present invention provides a pixel compensation circuit for using in an AMOLED display panel, As shown in FIG. 3, the pixel compensation circuit includes a light-emitting device, a reset module, a storage capacitor Cst, a first thin-film transistor T1, and a second thin-film transistor T2, a third thin-film transistors T3, a fifth thin-film transistor T5, and a sixth thin-film transistor T6, Here, the light-emitting device may be an OLED device.

Both ends of the storage capacitor Cst are respectively connected to a drain of the fifth thin-film transistor T5 and a gate of the first thin-film transistor T1.

A drain and a gate of the fifth thin-film transistor T5 are respectively connected to a power supply voltage signal VDD and the light-emitting signal EM(n), and a source of the fifth thin-film transistor T5 is connected to a drain of the first thin-film transistor T1.

A source of the first thin-film transistor T1 is connected to a drain of the sixth thin-film transistor T6, a source of the sixth thin-film transistor T6 is connected to an anode of the light-emitting device, and a gate of the sixth thin-film transistor T6 is connected to the light-emitting signal EM (n), a cathode of the light-emitting device is connected to a common terminal signal VSS.

The reset module is used to reset the gate of the first thin-film transistor T1 and the anode of the light-emitting device according to a second scanning signal B_S(n), and the second scanning signal B_S(n) includes a pulse in one frame period.

The reset module includes: a fourth thin-film transistor T4 and a seventh thin-film transistor T7.

Wherein gates of the fourth thin-film transistor T4 and the seventh thin-film transistor T7 are both connected to the second scanning signal, and drains of the fourth thin-film transistor T4 and the seventh thin film transistor T7 are both connected to a reset signal Vi, and sources of the fourth thin-film transistor T4 and the seventh thin-film transistor T7 are respectively connected to the gate of the first thin-film transistor T1 and the anode of the light-emitting device.

A drain and a gate of the second thin-film transistor T2 are respectively connected to a data signal DT and the first scanning signal A_S(n), and a source of the second thin-film transistor T2 is connected to the drain of the first thin-film transistor T1.

A drain of the third thin-film transistor T3 is connected to the drain of the fifth thin-film transistor T5 through the storage capacitor Cst, a gate of the third thin-film transistor T3 is connected to the first scanning signal A_S(n), and a source of the third thin-film transistor T3 is connected to the source of the first thin-film transistor T1.

The first scanning signal A_S(n) includes one or at least two continuous pulses in one frame time, and when the AMOLED display panel needs to perform a black insertion, a black insertion time is between a first pulse of the first scanning signal A_S(n) and a pulse of the second scanning signal B_S(n). When the second scanning signal B_S(n) includes at least two continuous pulses within one frame time, at least two continuous pulses correspond to pulses of the data signal DT. The above n is a natural number.

Figure 4:
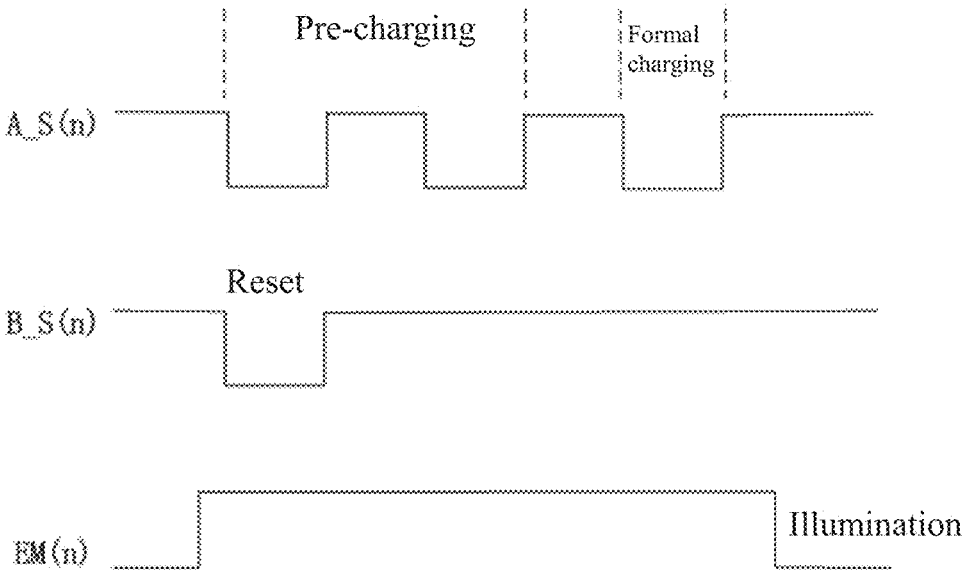
FIG. 4 is a first timing diagram of the first scanning signal having 3 pulses in one frame time provided by the present invention.

In an embodiment, as shown in FIG. 4, the first scanning signal A_S(n) includes 3 pulses in one frame time, and the gate of the first thin-film transistor T1 and the anode of the light-emitting device is reset through the second scanning signal B_S(n). The voltage level of the gate of the first thin-film transistor T1 and the anode of the light-emitting device is set as the voltage level of the reset signal Vi. The first scanning signal A_S(n) turns on the second thin-film transistor T2 and the third thin-film transistor T3 through the first two pulses in one frame time to pre-charge the first thin-film transistor T1. Then, the second thin-film transistor T2 and the third thin-film transistor T3 are turned on by a third pulse, and the first thin-film transistor T1 is formally charged, and being charged to a voltage level required for controlling the light-emitting device to perform normal light emission. The fifth thin-film transistor T5 and the sixth thin-film transistor T6 are turned on by the light-emitting signal EM(n), and the light-emitting device starts to emit light.

Furthermore, when the AMOLED display panel does not need to perform a black insertion, a time interval between the first pulse in the first scanning signal and the pulse in the second scanning signal is zero.

Furthermore, the thin-film transistors in the pixel compensation circuit are all P-type thin-film transistors.

The present invention also provides an AMOLED display panel, which includes a first GOA (Gate Driver on Array) driving circuit, a second GOA driving circuit, a third GOA driving circuit, and multiple pixel compensation circuits described above.

Figure 5:
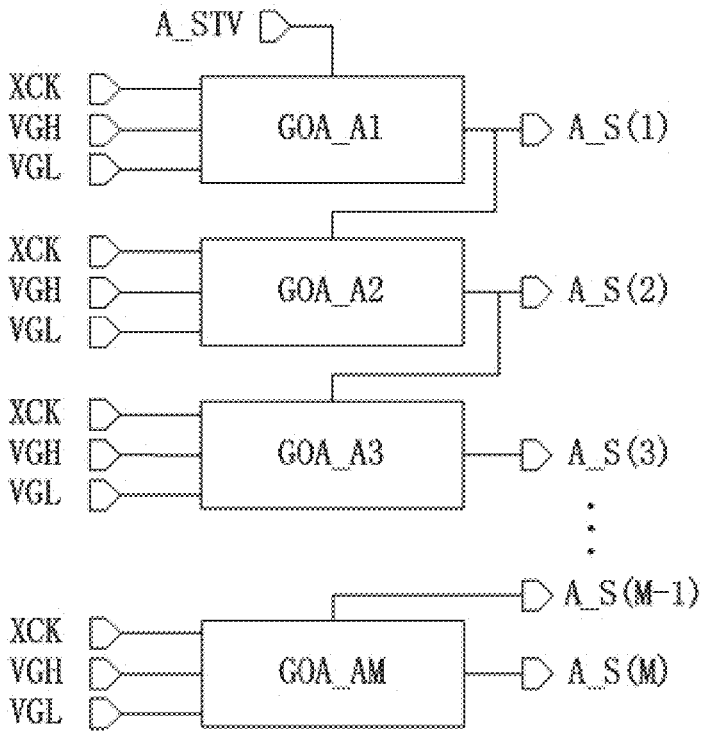
FIG. 5 is a schematic diagram of a first GOA driving circuit provided by the present invention.
Figure 6:
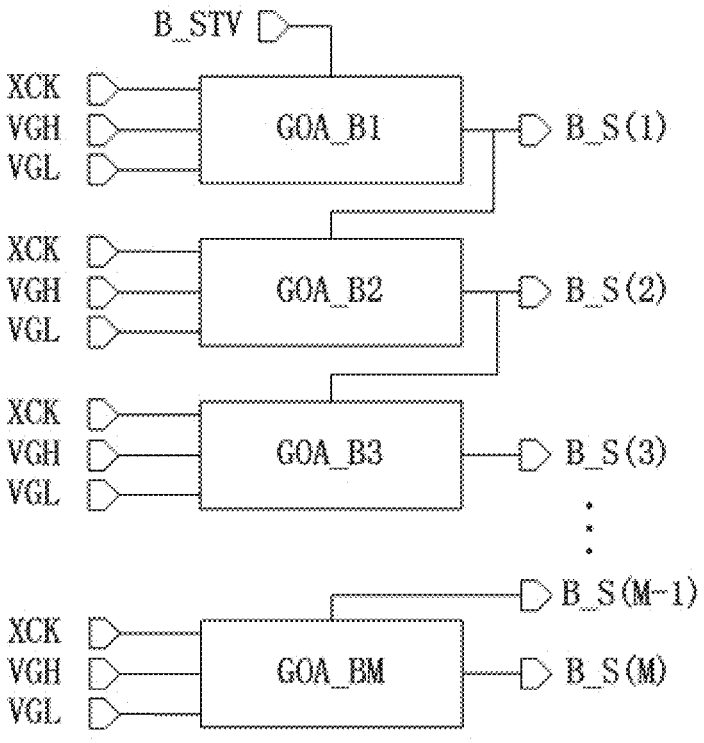
FIG. 6 is a schematic diagram of a second GOA driving circuit provided by the present invention.

As shown in FIG. 5, the first GOA driving circuit includes multiple cascaded first GOA units (GOA_A1, GOA_A2, . . . , GOA_AM). As shown in FIG. 6, the second GOA driving circuit includes a multiple cascaded second GOA units (GOA_B1, GOA_B2, . . . , GOA_BM), the third GOA driving circuit includes multiple cascaded third GOA units, and each pixel compensation circuit is connected with one of the first GOA units, one of the second GOA units and one of the third GOA units.

A first stage of the first GOA unit is inputted with an initial starting signal A_STV, a first stage of the second GOA unit is inputted with an initial starting signal B_STV, and a first stage of the third GOA unit is inputted with an initial starting signal EM_STV, and each stage of the first GOA unit and the second GOA unit are connected to an inverted clock signal XCK, a high voltage level signal VGH, and a low voltage level signal VGL; and the multiple stages of the first GOA unit outputs the first scanning signals A_S(1), A_S(2), . . . , A_S (M), the multiple stages of the second GOA unit outputs the second scanning signals B_S(1), B_S(2), . . . , B_S(M), respectively.

The third GOA unit is used to output a light-emitting signal to the gate of the fifth thin-film transistor T5 and the gate of the sixth thin-film transistor T6.

The first GOA unit is used to output the first scanning signal to the pixel compensation circuit, and the second GOA unit is used to output the second scanning signal to the pixel compensation circuit.

Figure 7:
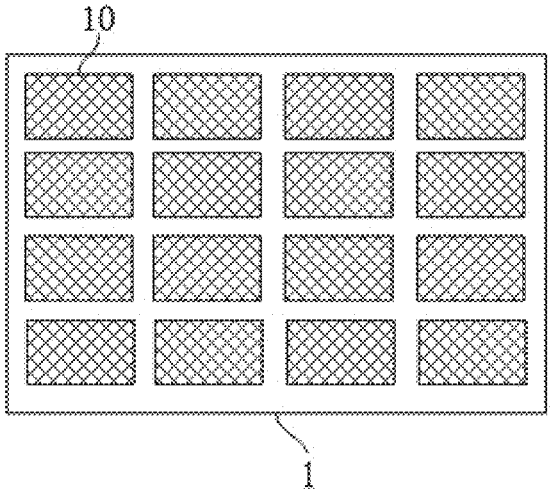
FIG. 7 is a schematic diagram of a pixel compensation circuit of an array arrangement provided by the present invention.

Furthermore, as shown in FIG. 7, the numeral 1 in FIG. 7 denotes an AMOLED display panel, the numeral 10 denotes the pixel compensation circuit, and multiple pixel compensation circuits are arranged as a matrix, that is, the multiple pixel compensation circuits are divided into multiple rows and columns. A same row of the pixel compensation circuits is inputted with a same first scanning signal and a same second scanning signal, and a same column of the pixel compensation circuits is inputted with a same data signal DT. The timings of the data signal DT inputted in the pixel compensation circuits at different columns are the same, that is, the pixel compensation circuits at different columns receive the pulses of the data signal DT at the same time and charge at the same time, but the voltage levels of pulses of data signals DT at the different column may be different.

Wherein, the first scanning signal accessed by an nth row of the pixel compensation circuits includes m pulses in one frame time, the first m−1 pulses of the m pulses correspond to pulses of the data signal DT to be accessed by the a previous row of pixel compensation circuits of the nth row of the pixel compensation circuits, and a last pulse of the m pulses corresponds to a pulse of the data signal DT to be accessed by the nth row of the pixel compensation circuits, n>2, m>2.

Figure 8:
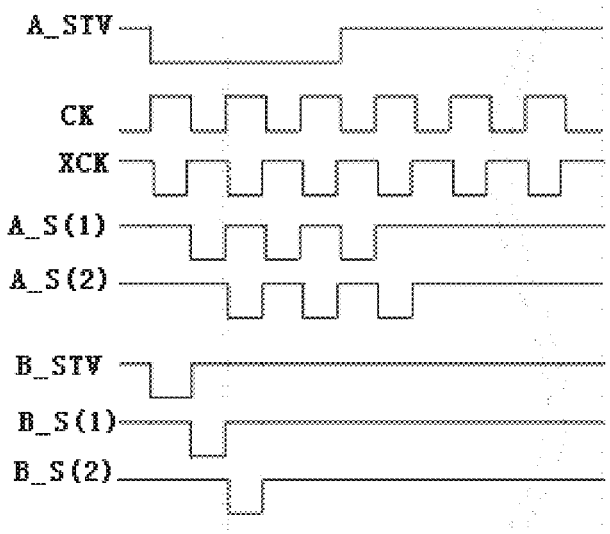
FIG. 8 is a second timing diagram of the first scanning signal having 3 pulses in one frame time provided by the present invention.

For example, in another embodiment, as shown in FIG. 8, the first scanning signal received by the first row of the pixel compensation circuits is A_S(1), and the first scanning signal received by the second row of the pixel compensation circuits is A_S(2). The second scanning signal received by the first row of the pixel compensation circuits is B_S(1), and the second scanning signal received by the second row of pixel compensation circuits is B_S(2). It can be seen that the second scanning signal sequentially resets the pixel compensation circuits row by row, and the first scanning signal sequentially turns on the second thin-film transistor T2 and the third thin-film transistor T3 of the pixel compensation circuit three times.

It should be noted that, in this embodiment, the first two pulses of the first scanning signal received by the third row of the pixel compensation circuits correspond to the last two pulses of the first scanning signal received by the first row of the pixel compensation circuits. Similarly, the first two of the first scanning signals received by the fourth row of the pixel compensation circuits correspond to the last two of the first scanning signals received by the second row of the pixel compensation circuits.

That is, when the second thin-film transistor T2 and the third thin-film transistor T3 of the first row of the pixel compensation circuits are turned on for the second time and the third time, the pulses of the data signal DT are respectively received for charging; at this time, the second thin-film transistor T2 and the third thin-film transistor T3 of the third row of the pixel compensation circuit are being turned on for the first time and the second time. The third row of the pixel compensation circuit can simultaneously receive the pulses of the data signal DT for pre-charging, so that the time for the third line of pixel compensation circuit to be charged for the third time is reduced, so that when the third row of pixel compensation circuit is turned on, the charging can be completed quickly.

Similarly, when the second thin-film transistor T2 and the third thin-film transistor T3 of the second row of the pixel compensation circuits are subjected to the second charging and the third charging, the second thin-film transistor T2 and the thin-film transistor T3 of the fourth row of the pixel driving circuits are also turned on for the first time and the second time. In this process, the fourth row of the pixel compensation circuits can be pre-charged, so that when the fourth row of the pixel compensation circuits is turned on for the third time, a quick charging can be completed. To avoid display failure of the display panel due to the slow charging speed of the pixel compensation circuit.

Figure 9:
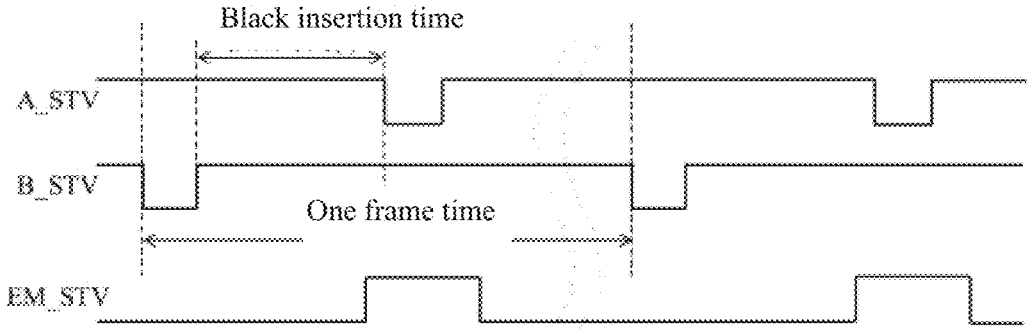
FIG. 9 is a timing diagram corresponding to an AMOLED display panel provided by the present invention when a black insertion is required.

In still another embodiment, when the AMOLED display panel needs a back insertion, as shown in FIG. 9, the pulses of the initial start signal A_STV accessed by the first GOA unit of the first stage is separated with one black insertion time in one frame period with respect to the initial start signal B_STV accessed by the second GOA unit of the first stage such that the pulses of the first scanning signal accessed by the same row of the pixel compensation circuits are also separated from the pulse of the second scan signal by one black insertion time. During each frame time, the pixel compensation circuit is turned on after a black insertion time is reset and after the pixel compensation circuit is reset (the pixel compensation circuit is turned on, that is, the second thin-film transistor T2 and the third thin-film transistor T3 are turned on). The pixel compensation circuit is prevented from being turned on during the black insertion time, and the first thin-film transistor T1 is still operated in the saturation region during the black insertion time, thereby improving the service life of the pixel compensation circuit.

Figure 10:
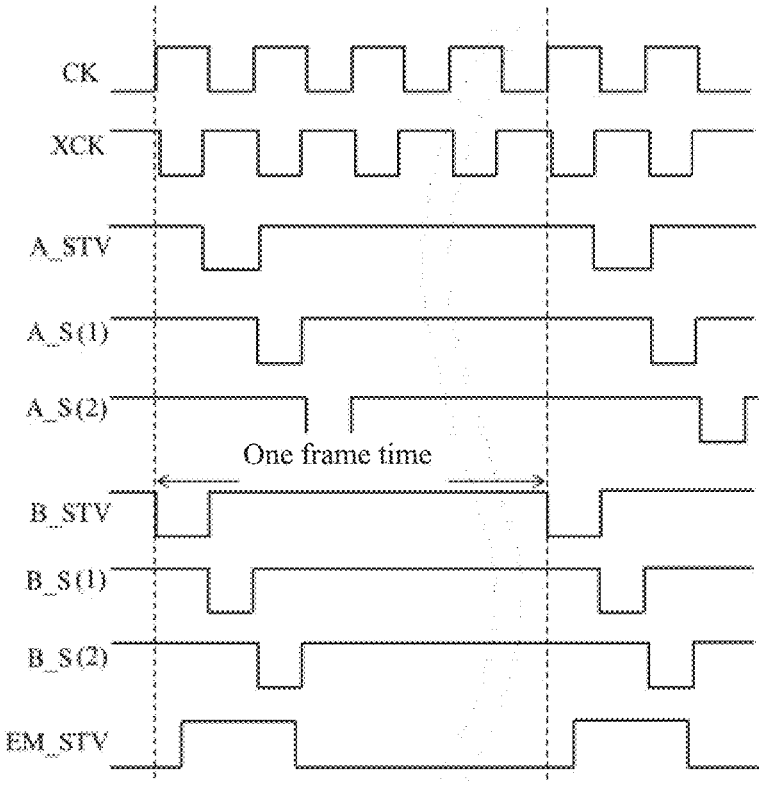
FIG. 10 is a timing diagram corresponding to the case where the AMOLED display panel provided by the present invention does not need a black insertion.

Of course, when the display panel does not need the black insertion, the pixel compensation circuit can be turned on immediately after the pixel compensation circuit is reset. As shown in FIG. 10, the interval between the pulse of the first scanning signal received by the first row of the pixel compensation circuits and the pulse of the second scanning signal received by the row of pixel compensation circuits is zero in one frame time. Similarly, during one frame time, the interval between the pulse of the first scanning signal received by the second row of the pixel compensation circuits and the pulse of the second scanning signal received by the row of the pixel compensation circuits is also zero.

The above-mentioned AMOLED display panel may be a rigid display panel, and may be, for example, a glass substrate or a flexible display panel.

Figure 11:
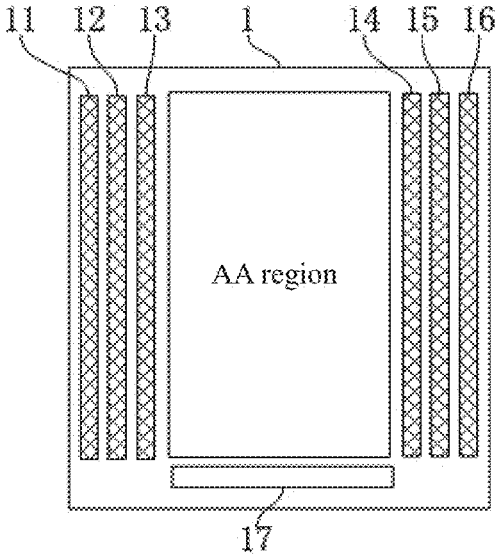
FIG. 11 is a schematic diagram of a rigid AMOLED display panel provided by the present invention.
Figure 12:
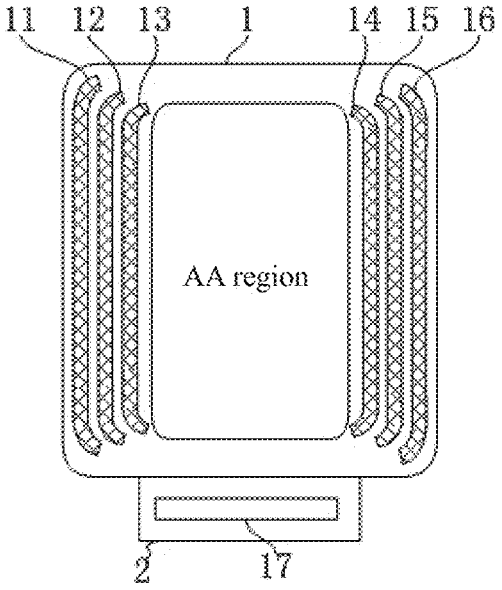
FIG. 12 is a schematic diagram of a flexible AMOLED display panel provided by the present invention.

FIG. 11 and FIG. 12 are flexible AMOLED display panels of a rigid AMOLED display panel, the numeral 1 denotes an AMOLED display panel, the numeral 17 denotes a bonding region, and the numeral 2 denotes a flexible circuit board. The numeral 11, 12, 13 corresponding to the AA region (active area region) on the left side of the first GOA driving circuit, the second driving circuit, the third driving circuit, the numeral 14, 15, 16 corresponding to the AA region on the right side of the first GOA driving circuit, the second driving circuit, the third driving circuit. The first GOA driving circuit, the second driving circuit, and the third driving circuit on the left side may be exchanged with each other, and the first GOA driving circuit, the second driving circuit, and the third driving circuit on the right side may also be exchanged with each other.

The present invention further comprises a driving method for a pixel compensation circuit for using in an AMOLED display panel, and the driving method includes following steps:

outputting a second scanning signal to the reset module to reset the gate of the first thin-film transistor T1 and the anode of the light-emitting device;

outputting a first scanning signal to the gates of the second thin-film transistor T2 and the third thin-film transistor T3;

Wherein the second scanning signal includes one pulse in one frame time, the first scanning signal includes one or at least two continuous pulses in one frame time, and when the AMOLED display panel needs to perform a black insertion, a black insertion time is between a first pulse of the first scanning signal and a pulse of the second scanning signal B_S(n). When the second scanning signal B_S(n) includes at least two continuous pulses within one frame time, at least two continuous pulses correspond to pulses of the data signal DT accessed at the drain of the second thin-film transistor T2.

Furthermore, when the number of the pixel compensation circuits is multiple and the multiple pixel compensation circuits are arranged as a matrix, the driving method for the pixel compensation circuit includes the following steps:

Outputting the first scanning signal and the second scanning signal to each row of the pixel compensation circuits, and outputting the data signal DT to each column of the pixel compensation circuits;

Wherein, outputting the same first scanning signal and the same second scanning signal to the same row of the pixel compensation circuits, and outputting the same data signal DT to the same column of the pixel compensation circuits, and the first scan signal includes m pulses.

Wherein, the first m−1 pulses of the m pulses accessed by an nth row of the pixel compensation circuits includes m pulses in one frame time correspond to pulses of the data signal DT to be accessed by the a previous row of pixel compensation circuits of the nth row of the pixel compensation circuits, and a last pulse of the m pulses corresponds to a pulse of the data signal DT to be accessed by the nth row of the pixel compensation circuits, $n>2$, $m>2$.

Furthermore, when outputting the first scanning signal to the first row of the pixel compensation circuits, the data signal DT includes pulses corresponding to m pulses of the first scanning signal received by the first row of the pixel compensation circuits: when outputting the first scanning signal to the second row of pixel compensation circuits, the data signal DT includes pulses corresponding to m pulses of the first scanning signal received by the second row of the pixel compensation circuits.

Furthermore, when the AMOLED display panel does not need to perform a black insertion, the interval between the first pulse in the first scanning signal and the pulse in the second scanning signal is zero.

In summary, in the pixel compensation circuit provided by the present invention, the interval between the pulse of the first scanning signal and the pulse of the second scanning signal can be adjusted to a black insertion time within one frame time. The pixel compensation circuit is not turned on during the black insertion time, so that the first thin-film transistor T1 does not operate in a saturated state, thereby prolonging the service life of the pixel compensation circuit. Moreover, the number of pulses of the first scanning signal is adjusted within one frame time such that the pulse of the first scanning signal within one frame time corresponds to the pulse of the data signal DT. The pixel compensation circuit can be pre-charged for the first thin-film transistor T1 several times before. When the pixel compensation circuit is turned on for the last time, the first thin film transistor T1 can be quickly charged to the on state. Accordingly, the situation that the charging time is slow and the first thin-film transistor T1 cannot be fully turned on so that the corresponding light emitting device cannot be normally displayed, which affects the display effect of the display panel is avoided. Therefore, the present invention cannot only extend the service life of the pixel compensation circuit, but also improve the display effect and quality of the display panel.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A pixel compensation circuit for using in an AMOLED display panel, comprising:

a light-emitting device, a reset module, a storage capacitor, a first thin-film transistor, a second thin-film transistor, a third thin-film transistors, a fifth thin-film transistor, and a sixth thin-film transistor;

wherein both ends of the storage capacitor are respectively connected to a drain of the fifth thin-film transistor and a gate of the first thin-film transistor;

wherein a drain and a gate of the fifth thin-film transistor are respectively connected to a power supply voltage signal and the light-emitting signal, and a source of the fifth thin-film transistor is connected to a drain of the first thin-film transistor;

wherein a source of the first thin-film transistor is connected to a drain of the sixth thin-film transistor, a source of the sixth thin-film transistor is connected to an anode of the light-emitting device, and a gate of the sixth thin-film transistor is connected to the light-emitting signal, a cathode of the light-emitting device is connected to a common terminal signal;

wherein the reset module is used to reset the gate of the first thin-film transistor and the anode of the light-emitting device according to a second scanning signal, and the second scanning signal includes a pulse in one frame period;

wherein a drain and a gate of the second thin-film transistor are respectively connected to a data signal and the first scanning signal, and a source of the second thin-film transistor is connected to the drain of the first thin-film transistor;

wherein a drain of the third thin-film transistor is connected to the drain of the fifth thin-film transistor through the storage capacitor, a gate of the third thin-film transistor is connected to the first scanning signal, and a source of the third thin-film transistor is connected to the source of the first thin-film transistor;

wherein the reset module includes: a fourth thin-film transistor and a seventh thin-film transistor; and wherein gates of the fourth thin-film transistor and the seventh thin-film transistor are both connected to the second scanning signal, and drains of the fourth thin-film transistor and the seventh thin film transistor are both connected to a reset signal, and sources of the fourth thin-film transistor and the seventh thin-film transistor are respectively connected to the gate of the first thin-film transistor and the anode of the light-emitting device.

2. The pixel compensation circuit according to claim 1, wherein the first scanning signal includes one or at least two continuous pulses in one frame time, and when the AMOLED display panel needs to perform a black insertion, a black insertion time is between a first pulse of the first scanning signal and a pulse of the second scanning signal, when the second scanning signal includes at least two continuous pulses within one frame time, at least two continuous pulses correspond to pulses of the data signal;

when the AMOLED display panel does not need to perform a black insertion, a time interval between the first pulse in the first scanning signal and the pulse in the second scanning signal is zero.

3. The pixel compensation circuit according to claim 1, wherein the thin-film transistors in the pixel compensation circuit are all P-type thin-film transistors.

4. AMOLED display panel, comprising: a first GOA driving circuit, a second GOA driving circuit, a third GOA driving circuit, and multiple pixel compensation circuits;

wherein each pixel compensation circuit comprises:

a light-emitting device, a reset module, a storage capacitor, a first thin-film transistor, a second thin-film transistor, a third thin-film transistors, a fifth thin-film transistor, and a sixth thin-film transistor;

wherein both ends of the storage capacitor are respectively connected to a drain of the fifth thin-film transistor and a gate of the first thin-film transistor;

wherein a drain and a gate of the fifth thin-film transistor are respectively connected to a power supply voltage signal and the light-emitting signal, and a source of the fifth thin-film transistor is connected to a drain of the first thin-film transistor;

wherein a source of the first thin-film transistor is connected to a drain of the sixth thin-film transistor, a source of the sixth thin-film transistor is connected to an anode of the light-emitting device, and a gate of the sixth thin-film transistor is connected to the light-emitting signal, a cathode of the light-emitting device is connected to a common terminal signal;

wherein the reset module is used to reset the gate of the first thin-film transistor and the anode of the light-emitting device according to a second scanning signal, and the second scanning signal includes a pulse in one frame period;

wherein a drain and a gate of the second thin-film transistor are respectively connected to a data signal and the first scanning signal, and a source of the second thin-film transistor is connected to the drain of the first thin-film transistor;

wherein a drain of the third thin-film transistor is connected to the drain of the fifth thin-film transistor through the storage capacitor, a gate of the third thin-film transistor is connected to the first scanning signal, and a source of the third thin-film transistor is connected to the source of the first thin-film transistor;

wherein the first GOA driving circuit includes multiple cascaded first GOA units, the second GOA driving circuit includes a multiple cascaded second GOA units, the third GOA driving circuit includes multiple cascaded third GOA units, each pixel compensation circuit is connected with one of the first GOA units, one of the second GOA units and one of the third GOA units;

wherein the third GOA unit is used to output a light-emitting signal to the gate of the fifth thin-film transistor and the gate of the sixth thin-film transistor; and wherein the first GOA unit is used to output the first scanning signal to the pixel compensation circuit, and the second GOA unit is used to output the second scanning signal to the pixel compensation circuit.

5. The AMOLED display panel according to claim 4, wherein multiple pixel compensation circuits are arranged as a matrix, a same row of the pixel compensation circuits is inputted with a same first scanning signal and a same second scanning signal, and a same column of the pixel compensation circuits is inputted with a same data signal;

wherein the first scanning signal accessed by an nth row of the pixel compensation circuits includes in pulses in one frame time, the first m−1 pulses of the in pulses correspond to pulses of the data signal to be accessed by the a previous row of pixel compensation circuits of the nth row of the pixel compensation circuits, and a last pulse of the in pulses corresponds to a pulse of the data signal to be accessed by the nth row of the pixel compensation circuits.

6. The AMOLED display panel according to claim 4, wherein the reset module includes: a fourth thin-film transistor and a seventh thin-film transistor;

wherein gates of the fourth thin-film transistor and the seventh thin-film transistor are both connected to the second scanning signal, and drains of the fourth thin-film transistor and the seventh thin film transistor are both connected to a reset signal, and sources of the fourth thin-film transistor and the seventh thin-film transistor are respectively connected to the gate of the first thin-film transistor and the anode of the light-emitting device.

7. The AMOLED display panel according to claim 4, wherein the first scanning signal includes one or at least two continuous pulses in one frame time, and when the AMOLED display panel needs to perform a black insertion, a black insertion time is between a first pulse of the first scanning signal and a pulse of the second scanning signal, when the second scanning signal includes at least two continuous pulses within one frame time, at least two continuous pulses correspond to pulses of the data signal;

when the AMOLED display panel does not need to perform a black insertion, a time interval between the first pulse in the first scanning signal and the pulse in the second scanning signal is zero.

8. The AMOLED display panel according to claim 4, wherein the thin-film transistors in the pixel compensation circuit are all P-type thin-film transistors.

9. A driving method for a pixel compensation circuit for using in an AMOLED display panel, wherein the pixel compensation circuit comprises:

a light-emitting device, a reset module, a storage capacitor, a first thin-film transistor, a second thin-film transistor, a third thin-film transistors, a fifth thin-film transistor, and a sixth thin-film transistor;

wherein both ends of the storage capacitor are respectively connected to a drain of the fifth thin-film transistor and a gate of the first thin-film transistor;

wherein a drain and a gate of the fifth thin-film transistor are respectively connected to a power supply voltage signal and the light-emitting signal, and a source of the fifth thin-film transistor is connected to a drain of the first thin-film transistor;

wherein a source of the first thin-film transistor is connected to a drain of the sixth thin-film transistor, a source of the sixth thin-film transistor is connected to an anode of the light-emitting device, and a gate of the sixth thin-film transistor is connected to the light-emitting signal, a cathode of the light-emitting device is connected to a common terminal signal;

wherein the reset module is used to reset the gate of the first thin-film transistor and the anode of the light-emitting device according to a second scanning signal, and the second scanning signal includes a pulse in one frame period;

wherein a drain and a gate of the second thin-film transistor are respectively connected to a data signal and the first scanning signal, and a source of the second thin-film transistor is connected to the drain of the first thin-film transistor; and wherein a drain of the third thin-film transistor is connected to the drain of the fifth thin-film transistor through the storage capacitor, a gate of the third thin-film transistor is connected to the first scanning signal, and a source of the third thin-film transistor is connected to the source of the first thin-film transistor;

wherein the driving method for a pixel compensation circuit comprises steps of:

outputting a second scanning signal to the reset module to reset the gate of the first thin-film transistor and the anode of the light-emitting device; and outputting a first scanning signal to the gates of the second thin-film transistor and the third thin-film transistor;

wherein the second scanning signal includes one pulse in one frame time, the first scanning signal includes one or at least two continuous pulses in one frame time, and when the AMOLED display panel needs to perform a black insertion, a black insertion time is between a first pulse of the first scanning signal and a pulse of the second scanning signal, when the second scanning signal includes at least two continuous pulses within one frame time, at least two continuous pulses correspond to pulses of the data signal accessed at the drain of the second thin-film transistor;

wherein when the number of the pixel compensation circuits is multiple and the multiple pixel compensation circuits are arranged as a matrix, the driving method for the pixel compensation circuit includes the following steps:

outputting the first scanning signal and the second scanning signal to each row of the pixel compensation circuits, and outputting the data signal DT to each column of the pixel compensation circuits;

wherein outputting the same first scanning signal and the same second scanning signal to the same row of the pixel compensation circuits, and outputting the same data signal DT to the same column of the pixel compensation circuits, and the first scan signal includes in pulses;

wherein the first m−1 pulses of the in pulses accessed by an nth row of the pixel compensation circuits includes in pulses in one frame time correspond to pulses of the data signal to be accessed by the a previous row of pixel compensation circuits of the nth row of the pixel compensation circuits, and a last pulse of the in pulses corresponds to a pulse of the data signal DT to be accessed by the nth row of the pixel compensation circuits, n>2, m>2.

10. The driving method for a pixel compensation circuit according to claim 9, wherein when outputting the first scanning signal to the first row of the pixel compensation circuits, the data signal DT includes pulses corresponding to in pulses of the first scanning signal received by the first row of the pixel compensation circuits; and when outputting the first scanning signal to the second row of pixel compensation circuits, the data signal DT includes pulses corresponding to in pulses of the first scanning signal received by the second row of the pixel compensation circuits.

11. The driving method for a pixel compensation circuit according to claim 9, wherein when the AMOLED display panel does not need to perform a black insertion, the interval between the first pulse in the first scanning signal and the pulse in the second scanning signal is zero.

* * * * *